US005506010A

United States Patent [19]

Buck et al.

[11] Patent Number: 5,506,010

[45] Date of Patent: Apr. 9, 1996

[54] MOTIVATIONAL DEVICE

[75] Inventors: David L. Buck, Minneapolis; Ferdinand J. Herpers, Minnetonka; Jack K. Hockenberry, Albert Lea, all of Minn.

[73] Assignee: Quest Your Best, Inc., Minneapolis, Minn.

[21] Appl. No.: 278,046

[22] Filed: Jul. 20, 1994

[51] Int. Cl.[6] ..... A47G 35/00

[52] U.S. Cl. ..... 428/14; 428/542.2; 40/431; 40/432; 362/806

[58] Field of Search ..... 428/542.2, 14, 428/7; 362/806; 40/431, 432, 441

[56] References Cited

U.S. PATENT DOCUMENTS

| | | | |
|---|---|---|---|
| D. 99,693 | 5/1936 | Babcock | D6/99 |
| D. 127,448 | 5/1941 | Coller | D34/11 |
| D. 135,541 | 4/1943 | Smith | D34/11 |
| D. 161,937 | 2/1951 | Kelly | D52/4 |
| D. 201,974 | 8/1965 | Bell | D34/11 |
| D. 239,575 | 4/1976 | Powell, Jr. | D6/99 |
| 895,116 | 8/1908 | Shepard et al. | 232/5 |
| 2,345,517 | 3/1944 | Weiss | 40/441 |
| 2,425,874 | 8/1947 | Gray | 232/5 |
| 2,605,893 | 8/1952 | Leavitt | 206/44.11 |
| 2,876,339 | 3/1959 | Thorne | 40/441 |
| 2,894,748 | 7/1959 | Curtis | 273/148 |
| 3,161,351 | 12/1964 | Lerner | 232/5 |
| 4,026,309 | 5/1977 | Howard | 133/8 R |

*Primary Examiner*—Alexander S. Thomas
*Attorney, Agent, or Firm*—Westman, Champlin & Kelly

[57] ABSTRACT

A motivational device has a vertical support for supporting medallions indicating steps or levels of achieving a goal to permit visual identification of accomplishments leading toward a goal, and when such goal is reached. The device is supported on a base and combined with a supported sculptural work of art. The achievement indicating medallions can be inserted from the exterior of the work of art, and include medallions that are opaque and medallions that are light transmitting and of different colors, for indicating achievement of steps toward a goal. A light source is utilized so that as light transmitting medallions are added to replace opaque medallions, light will pass through the medallion and indicate visually the achievements being made toward a specific goal.

20 Claims, 7 Drawing Sheets

MOTIVATIONAL DEVICE

BACKGROUND OF THE INVENTION

The present invention relates to a motivational reminder device which provides an attractive sculptural work of art that supports indicia for visually indicating progressive steps toward achieving selected goals represented on the sculptural work of art. The sculptural work of art provides an attractive, decorative office or home furnishing.

Various motivational devices have been used in the past. Well known "thermometer" type graphs have been provided for indicating progress toward a financial goal for charity giving, for example, with the thermometer generally being colored in to show the present percentage of contribution toward a goal. Additionally, bar and line graphs and charts are used, having lines or bars indicating progress toward goals of various kinds.

It is also known that objects can be stacked one on top of another, such as coins or poker chips. However, such devices are merely storage supports, that will hold generally flat objects in position relatively contiguous to each other.

Typical devices that illustrate stacking coins or the like include U.S. Pat. No. Des. 201,974, which has an enlarged top, and forms a single coin column. U.S. Pat. No. 3,161,351 is a savings bank which permits different denomination coins to be stacked in tubes formed on the support.

U.S. Pat. No. Des. 239,575 shows a coin holder that has part cylindrical members that receive coins of different sizes, and slots are provided to the exterior so that the coins can be lifted out of the holder by insertion of a finger or bar through the slot.

A chip counter that supports poker chips in a holder having an opening slot is shown in U.S. Pat. No. 4,026,309. Additional coin containers or similar devices that have vertical stacking supports include U.S. Pat. No. 2,425,874 and U.S. Pat. Nos. Des. 99,693; 127,448; and 161,937.

Additionally a portable savings bank that supports coins on generally upright but inclined columns is shown in U.S. Pat. No. 895,116, and a coin holder of general interest is shown in U.S. Pat. No. Des. 135,541.

Prior art of general interest include a bottle cap display structure shown in U.S. Pat. No. 2,605,893 and a game shown in U.S. Pat. No. 2,894,748.

The present invention discloses a device that permits the unique display of indicia indicating achievement of particular steps, or indicating general progress, toward a goal. The device can be displayed in an office or home with its attractive sculptural, artistically pleasing, support.

SUMMARY OF THE INVENTION

The present invention relates to a motivational device which comprises a support that supports individual medallions or indicia that indicate steps toward a goal represented at a "goal" end of a retainer structure for the medallions or indicia. The retainer is made so that the medallions can be inserted and removed from an exterior of the retainer to permit adding medallions as steps are accomplished. A visual display of progress toward the goal is present on the sculptural support.

As shown, the sculptural support is an obelisk supported on a base, and each of the four sides of the obelisk is provided with an upright slot opening into an interior chamber. The openings are elongated in vertical direction, and have upright, parallel side edges. The side edges are provided with medallion retainers that permit inserting and removing medallions as goals are achieved, in an easy manner. The retainers as shown are essentially liners that line the edges of the openings, the upright edge medallion retainers are resilient members that engage ends of generally elliptically shaped medallions. The medallions themselves are formed so that they will nest together to insure there is not any light transmitted between cracks in adjacent medallions and the edges are appropriately beveled to permit slipping a medallion between medallions already in an existing stack.

An interior light in the obelisk provides back lighting for the medallions. As shown, two types of medallions are provided, namely opaque and light transmitting. The light transmitting medallions can be made in differing colors to provide different indications of progress or to provide indications of progress toward different goals. The interior light is transmitted through the light transmitting medallions. The opaque medallions can be installed in the medallion retainer initially, and then as progress is made, the opaque medallions can be removed from the retainer as light transmitting medallions are inserted so that a visual impact of having a light shining through the medallion is provided to spur one on toward achieving the desired goal.

A base that supports the sculptural motivational device is also, is shown, a support for electronic components and memory that cooperate with a suitable display such as a vacuum fluorescent or LCD display to display messages, congratulatory information, percentage completion of desired goals, percentage completion of respective goal periods, and if wanted, date, time, and timer. The internal electronic components and memory storage for providing such messages can be customized to the user's needs, and can use any desired type of existing programmable message display.

The obelisk is rotatable on the base about an upright axis so each of the four sides can be moved to face the viewer. A switch system is used to indicate the positions of the obelisk sides relative to a side where a keypad can be accessed, so the proper information will be accessed from memory for display of the goal status of the respective sides in the home or reference position.

DETAILED DESCRIPTION OF THE PREFERRED EMBODIMENTS

Figure 2:
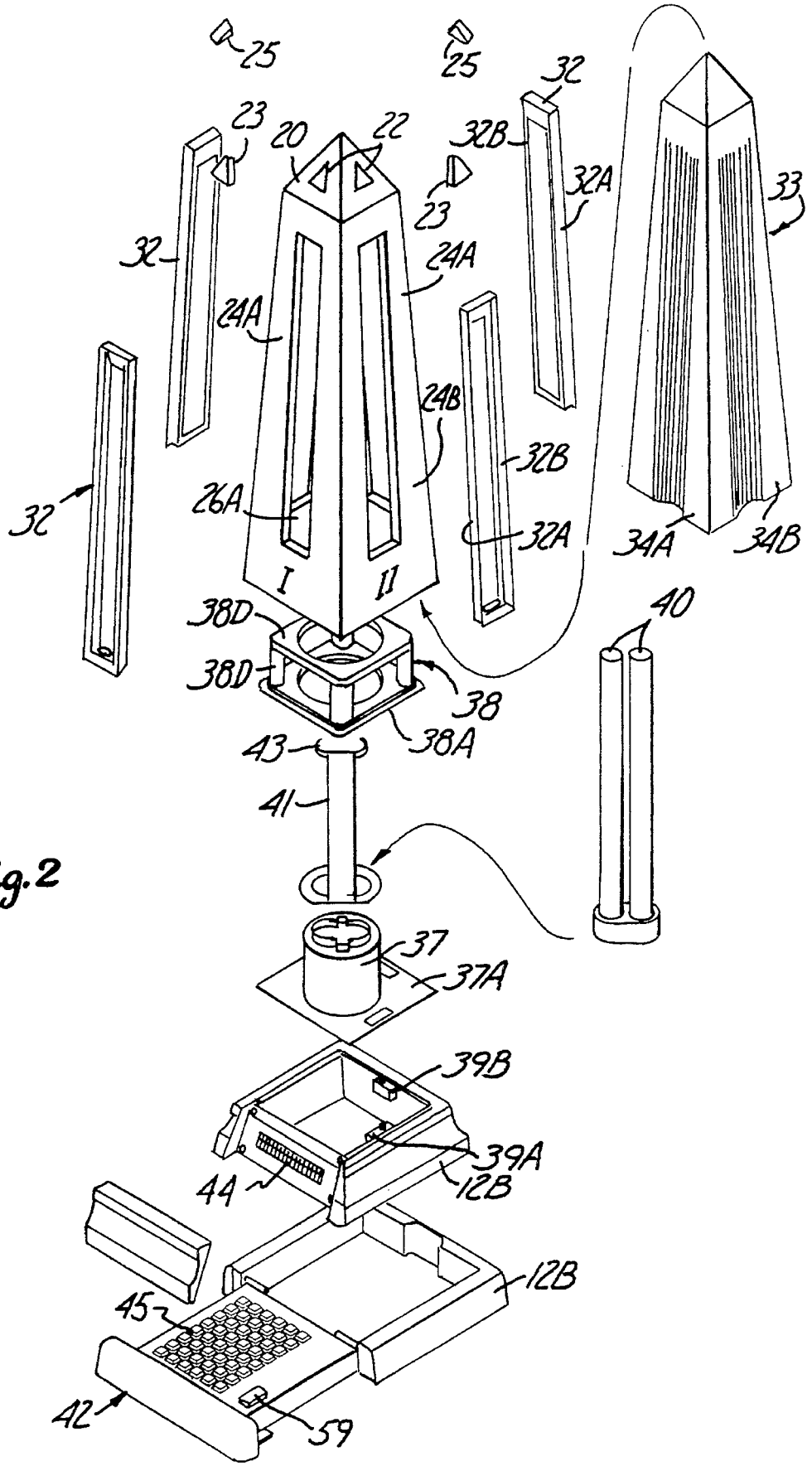
FIG. 2 is an exploded view of the device of FIG. 1.
Figure 3:
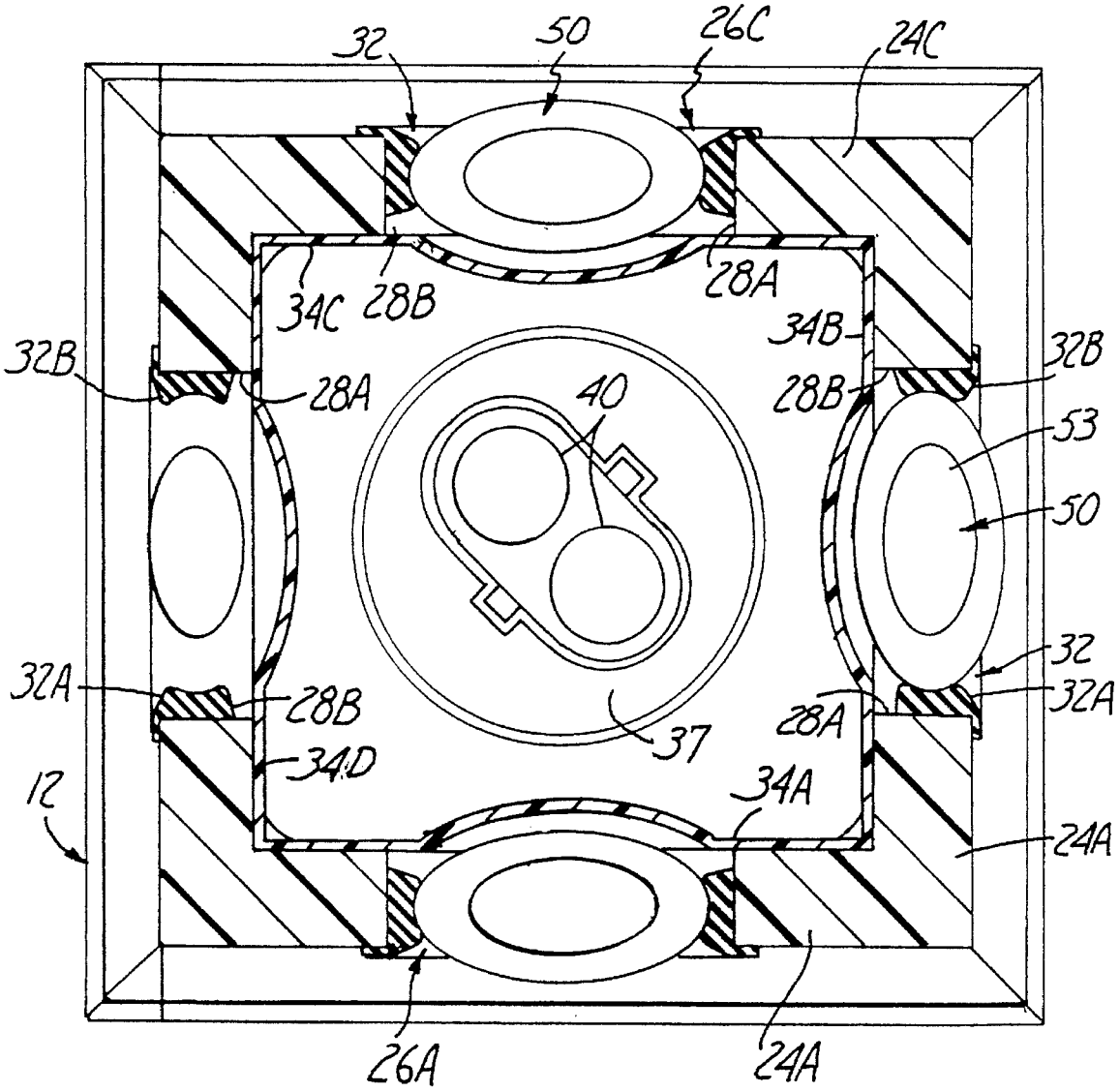
FIG. 3 is a cross sectional view of the device in FIG. 1 taken generally along line 3—3 in FIG. 1.

A motivational device indicated generally at 10 as shown comprises a sculptural work of art comprising an obelisk 11 having a base 12 that is tiered from a support or bottom end 14, up to an end 16 that supports the obelisk. The upper end of the obelisk 11 has an integral pyramidal cap 18 and as shown these are formed with triangular walls 20 each of which has a triangular opening in the center. The triangular openings are initially blocked on each side with a triangular insert 23 (FIG. 2). The inserts 23 are opaque and can be replaced with a colored, translucent insert.

The obelisk is made with four walls 24A, 24B, 24C, and 24D, each of which is provided with a generally upright opening therethrough, indicated at 26A, 26B, 26C, and 26D.

As shown, the openings have parallel lateral side edges 28A and 28B. The openings 26A–26D are elongated in vertical direction, and a resilient retainer gasket 32 is inserted in each opening 26 and has resilient strips 32A and 32B on each of the opposite edges 28A and 28B, respectively.

Figure 4:
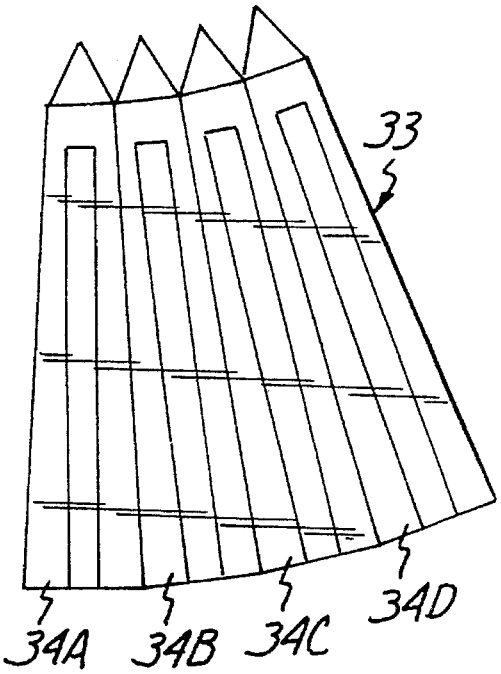
FIG. 4 is a flat layout view of a light diffusing insert lining the device of FIG. 1.

A transparent or translucent backing panel assembly 33 is shown in flat layout in FIG. 4 and formed in FIG. 2 and has panels 34A, 34B, 34C, and 34D that back each of the walls 24A–24D on the interior space indicated at 36. The backing panel assembly 33 forms a liner on the interior of the obelisk walls 26A–26D, and slips up into the interior of the obelisk. The panels 32A–32D have recessed sections aligning with the opening 26 in the respective wall 24 for medallion clearance, as will be observed. The backing panels 34A–34D are provided for light transmission and diffusion, and also prevent the medallions, which will be described, from being pushed completely through the openings 26 into the interior space of the obelisk.

A compact fluorescent lamp 40 is provided in the center of the interior space 32. The lamp forms a light source and is supported on one end only and will project light through the backing panels 34A–34D and the openings 26A–26D. The lamp 40 provides lighting through light transmitting medallions. The opaque medallions aid in the function of the device by blocking all light through the medallion column until removed.

Figure 8:
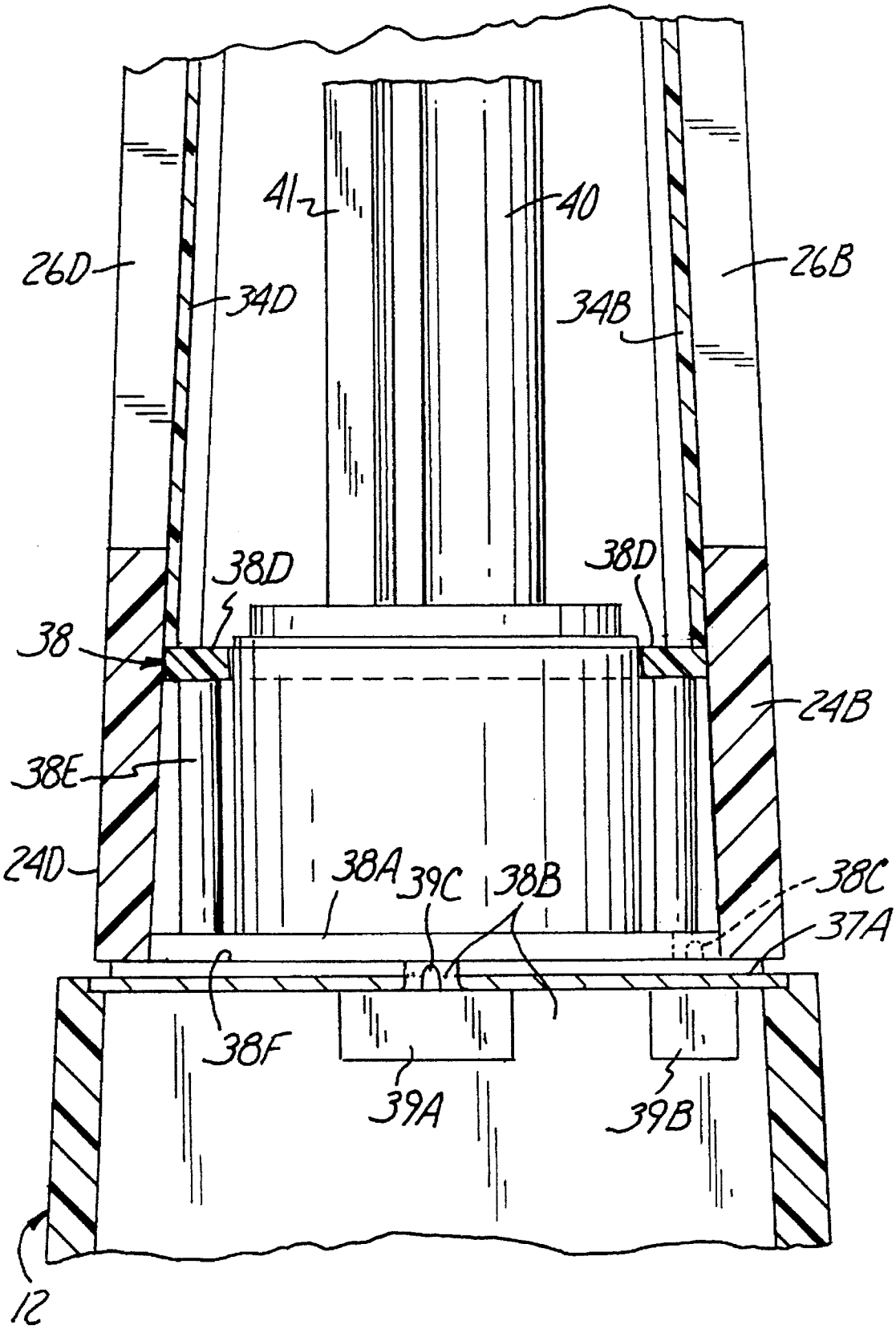
FIG. 8 is a fragmentary sectional view of a swivel assembly mounted on a base.
Figure 9:
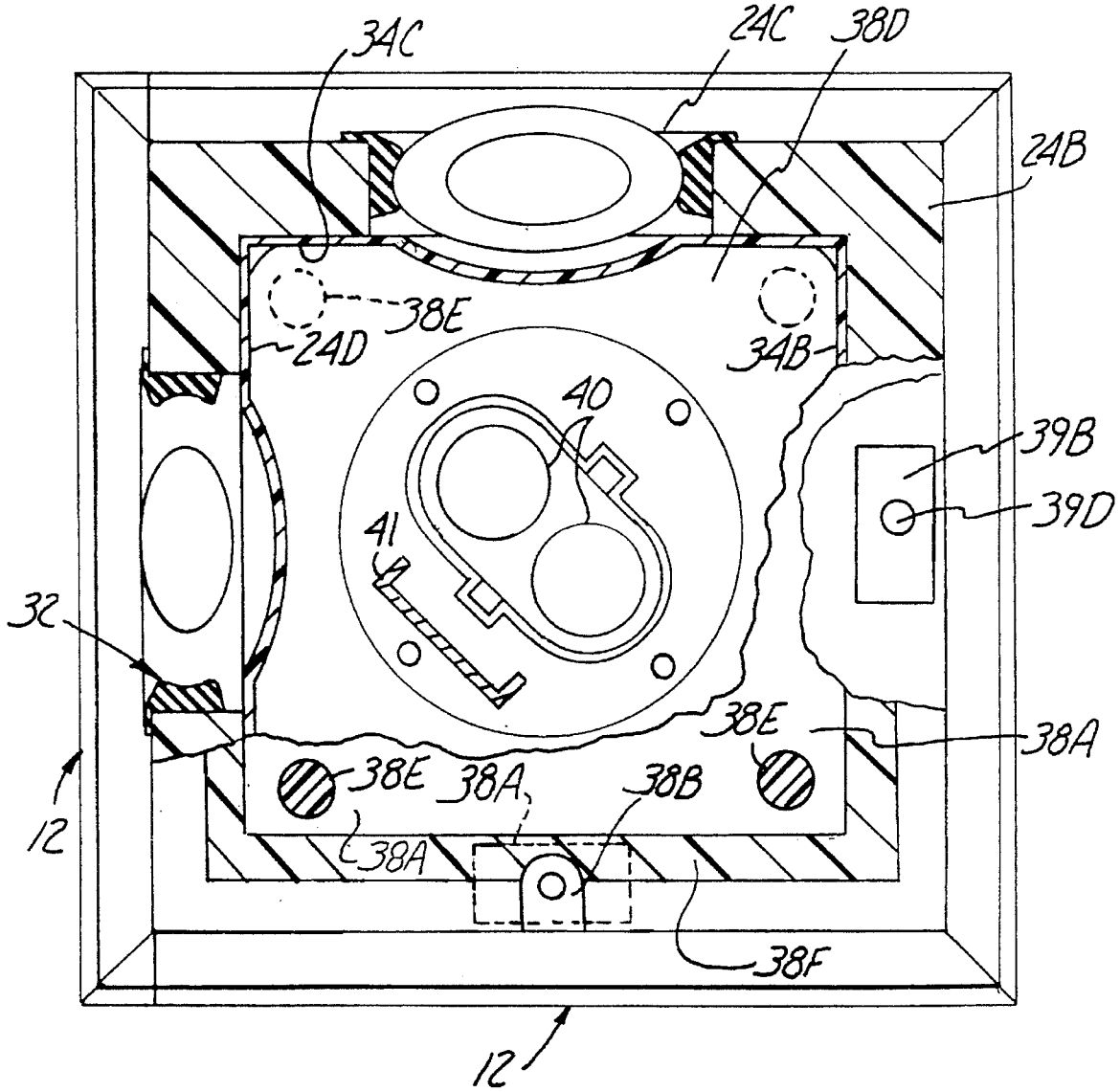
FIG. 9 is a plan view of the assembly of FIG. 8.

As shown in FIGS. 8 and 9, the lamp 40 is supported on a ballast housing 37 that has a base plate 37A that is fixed in a suitable manner on a shoulder at the top of the base 12. The ballast housing 37 is cylindrical and a swivel assembly 38 has an opening of size to the swivel assembly slips over the ballast housing. The swivel assembly has a lower plate 38A made of low friction material that rests on top of the ballast housing base plate 37A. The lower plate 38A has a thin peripheral lip 38F pre surrounding a thicker center section. The plate 38A has a flat bottom surface. The obelisk walls 24 are carried on the lip 38F of the swivel housing base plate 38A and thus the entire obelisk will rotate relative to the ballast housing and the base 12.

There are a pair of switches 39A and 39B mounted on the base below the ballast housing base plate 37A. The switches are positioned in openings in the ballast base plate. The switches 39A and 39B have spring loaded actuator buttons 39C and 39D that extend upwardly above the ballast housing base plate 37A. The lip 38F of the swivel assembly base plate 38A has notches 38B and 38C along two sides that will permit the spring loaded switch actuators 39C and 39D to move upwardly when the notches align with the actuator as shown in FIGS. 8 and 9 and cause the associated switch to change state from the state of the switch when under surface of the swivel base plate is depressing the respective switch button. When the portions of the swivel base plate 38A without the notches are over the switch actuator button, the actuator button holds that switch in a second state, either off or on.

The ballast housing 37 contains a ballast for the lamp 40 and has openings for plugging in the lamp 40 in the top of the ballast. A support 41 is attached to the top of the ballast carrier and a clip 43 at the top holds upper ends of lamps 40. (See FIG. 2)

As shown in FIGS. 8 and 9 the lower plate 38A of the swivel housing base rests on top of the ballast housing base plate 37 and will rotate thereon. The plate 37A of the ballast housing base is flush with or slightly above the top edge of the base 12 so the corners of the base place 38A of the swivel assembly can move outside the periphery of the base 12 as the obelisk is rotated.

As can be seen in FIG. 2, the base 12 is made up of sections 12A and 12B, and in the lower section 12B a drawer indicated generally at 42 can be a small alphanumeric keyboard 45 and switches for programming a display 44 using the computer components comprising micro computer chips, RAM and ROM, located in base section 12A. The display as shown, is a vacuum fluorescent panel display, and is mounted in the base 12. Messages can be displayed on the display panel, and can either be pre-programmed or customized for fulfilling individual needs. The base 12 also has surfaces for inscriptions, mounting of plaques, and the like.

Figure 5:
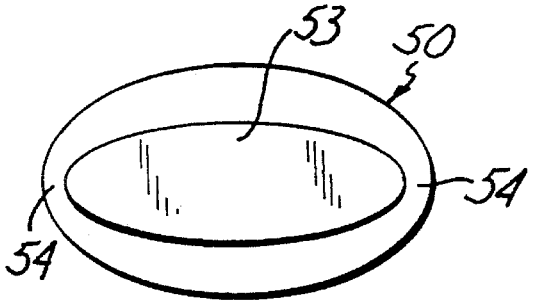
FIG. 5 is a plan view of a typical medallion used with the device of FIG. 1.
Figure 7:
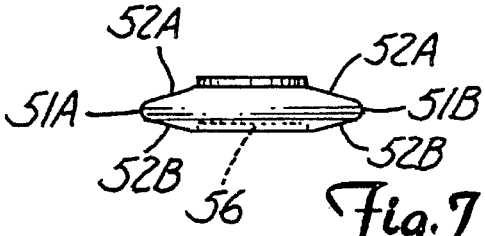
FIG. 7 is an end view of the medallion of FIG. 5.
Figure 6:
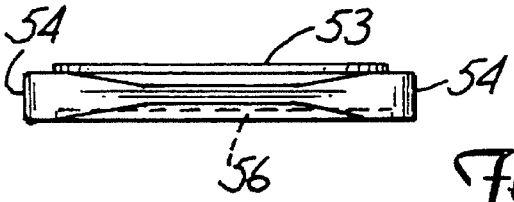
FIG. 6 is a side view of the medallion of FIG. 5.

The medallions or goal indicia members are shown in FIGS. 5, 6, and 7 comprise elliptically shaped medallions 50. In end view (FIG. 7) the medallions are shown to have rounded (small radius) longitudinal edges indicated at 51A and 51B, and tapered or beveled top and bottom side surface portions 52A and 52B extending from rounded edges 51A and 51B to a center raised portion 53. The ends indicated at 54 are also rounded, in plan view, as shown in FIG. 5, and as shown in FIG. 6 the center of the medallion is substantially full thickness between ends 54, with a raised portion 53 extending in longitudinal direction in the center portion of the medallion 50. As shown in the end view of FIG. 7, the raised center portion 55 of the medallion extends transversely or across its width between the top side surface portions 52A and 52B. The raised portion is to fit into or mate with a bottom recess or receptacle 56 shown in dotted lines in FIGS. 6 and 7. The recess or receptacle 56 is on the bottom of the medallion 50, and the raised portion of the next lower medallion fits into the receptacle 56 so that there are no light leaks between the contiguous medallions.

Figure 1:
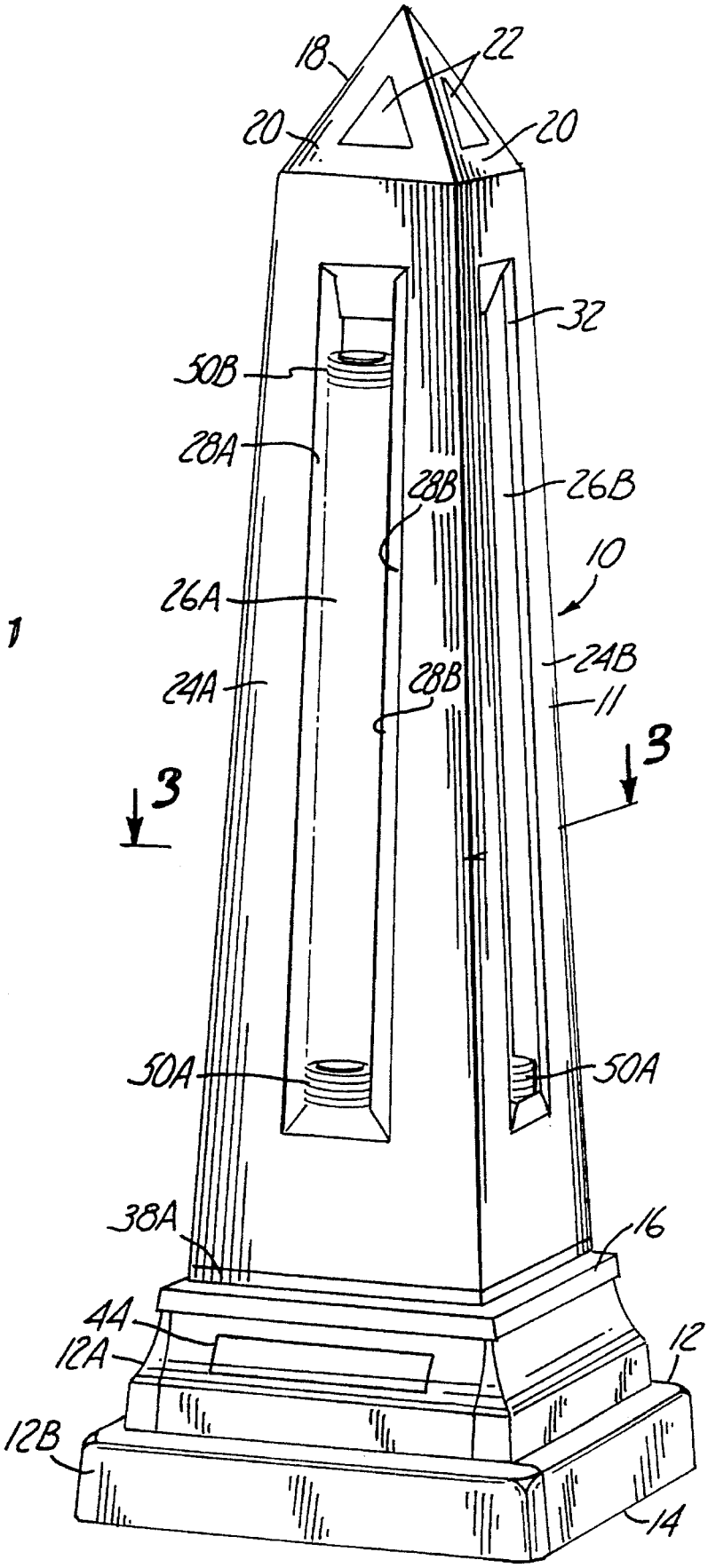
FIG. 1 has a perspective view of a motivational device made according to the present invention.

Medallions 50 come in two forms. A first form is light transmitting, either translucent or transparent, and also is in color such as yellow, red, green or the like, so when the medallions are in place in the medallion retainers in openings 26A–26D and light is projected through the openings 26A–26D, the light will be transmitted through the light transmitting medallions 50A (FIG. 1) for viewing from the exterior. Opaque medallions such as those shown at 50B in FIG. 1 are not light transmitting. Thus the interior light from lamps 40 cannot be seen from the exterior in portions of the openings 26 where the opaque medallions 50B are in place.

When the motivational device is put into use, the openings 26 and the resilient medallion retainers 32A and 32B are filled with opaque medallions 50B on the side or sides that represent the motivational goal or goals for the user of the motivational device. When a step toward a goal has been achieved, a particular selected light transmitting medallion of desired selected color will be inserted into the stack in the selected opening 26A–26D. An opaque medallion 50B can be removed from the top of the stack and the light transmitting medallion 50A can be inserted sideways or laterally in any vertical location of the stack because of the rounded edges 51A and 51B and the beveled top and bottom surface portions 52A and 52B. The resilient retainers 32A and 32B along the edges of respective openings 26A–26D will compress slightly when the medallions 50 are pushed into the retainers from the exterior, and will frictionally engage the end portions of the medallion to retain the medallion in its position in the selected opening 26A–26D. The light transmitting backing panels 33A–33D will prevent pushing the medallions through the openings. Medallions 50 also can be removed from a stack if a reversal of fortune occurs.

In FIGS. 8 and 9, details of the ballast housing 37 and the swivel base 38 are shown.

The ballast housing 37 is supported on suitable shoulders at the top of the base 12. The ballast housing 37 supports the ballast for lamp 40 on the inside of the ballast housing. The lamp support 41 is supported on top of the ballast housing, and as shown swivel assembly 38 has plates with openings that fit around the cylindrical ballast housing. The bottom plate 38A rests on top of the bottom plate 37A of the ballast housing. The bottom plate 38A has the lip 38F that forms a shoulder for supporting the obelisk walls 24, as shown in FIG. 8.

The swivel housing includes a top plate 38D that is supported relative to the bottom plate 38A with standoff spaces 38E that are fixed to the top and bottom plates to form an assembly. The standoff spaces 38E are at each of the corners of the bottom plate and the top plate of the swivel housing. The top plate 38D and bottom plate 38A have openings that surround the ballast housing 37 to guide the swivel housing for rotation.

The notches 38A and 38B in lip 38F for switch actuation are shown in FIG. 9, and as seen, the notches will align with the actuator buttons 39C and 39D of the switches 39A and 39B, respectively, as shown in FIG. 9 when the obelisk is in its position also shown in FIG. 9.

The switch button will move up into the notches when aligned with the notches, so that the state of the respective switch being operated will change when the swivel housing 38, and the obelisk carried by the swivel housing, are in the position shown in FIG. 9. When obelisk is rotated 90 degrees from the position shown in FIG. 9, the notch 38A will be over the switch actuator button 39D, and permit that switch to be changed in state from the position in which the switch actuator is not permitted to move up, but the switch actuator 39C will remain down below the plane of the lower side of the swivel base 38A, so that the switch 38A will be in a different state than the switch 39A.

These switch signals are used for determining the position of the obelisk, by utilizing the signals from the switches and combining them for indication of position. For example, if the position shown at FIG. 9 is the reference position, both the switches 39A and 39B will be "on" Rotating the obelisk 90 degrees counter clockwise will have switch 39A off and switch 39B on; rotating it another 90 degrees will switch both of the switches "off" because neither of the notches 38A or 38B will be over the switch buttons; rotating the obelisk 270 degrees would place the notch 38B over switch button 39C to permit switch 39A to be actuated, and then the obelisk another 90 degrees would lead back to the position shown at FIG. 9.

Thus, the four positions of the obelisk can be determined just by using signals from two switches and two switch actuators notches carried on the swivel housing. The obelisk rotates around the lamps 40 and lamp support 41.

The visual message display 44 can be made to provide congratulations, or indicate a percent of achievement toward a goal for each side of the obelisk, which forms a separate goal path. The switch status as described above is used by memory in the electronic components to provide the correct status of the goal being viewed. The messages can be preprogramed and sequentially and periodically displayed under a preselected program when a power switch 59 is turned on, or the message may be customized for use by the operator through the use of the alphanumeric keyboard 45.

The uses for the motivational device of the present invention are limited only by the creativity of the user, and can be just a straight counting of days, for example, by the replacement of opaque medallions with translucent medallions, as well as the goal orientation to show the percentage of accomplishments before reaching one's goal. The goal could be a sales goal, or some personal goal. The nesting of the medallions or indicia members insures that there will be no light leakage between the opaque medallions that are included, so that there is no distraction of leaking light and the only transmission of light will be through the light transmitting medallions that indicate some steps that have been taken to accomplish a goal.

Figure 10:
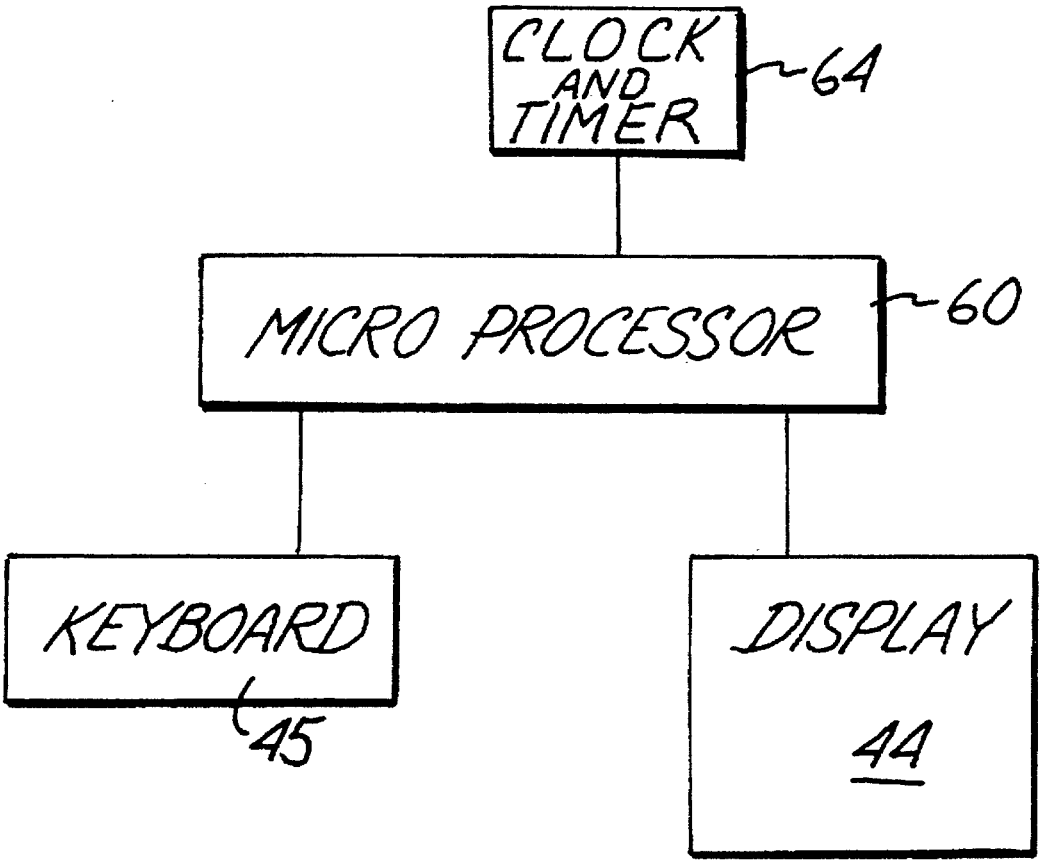
FIG. 10 is a block diagram of a typical programmable display utilized with the device of the present invention.

A simplified block diagram of a microprocessor 60 that is in upper base 12A and is used with the display 44 is illustrated FIG. 10. The keyboard 45 can be used for programming the display directly or can be the input to a permanent memory storage section 63. The input can be for recorded achievements as medallions are added for each goal path on there can be preprogrammed messages that will be sequentially produced in response to the signals from switches 39A and 39B or provided after an elapsed time. Date, day and time can be displayed, as well as days remaining to achieve a goal on each side or station of the obelisk.

A clock 64 can be provided to control time and date display. The power may come from a battery. Small micro processors are available to drive message displays as desired.

The block diagram is merely as illustrative, and components are presently available for carrying out the functions desired. The display can be an LCD display or any type of electronic display.

The programming of the unit can be done as desired.

Although the present invention has been described with reference to preferred embodiments, workers skilled in the art will recognize that changes may be made in form and detail without departing from the spirit and scope of the invention.

What is claimed is:

1. A motivational device for indicating steps in achievement of a goal comprising;

a support member comprising an obelisk having four generally upright walls supported on a base;

a medallion retainer on each of the walls of the support member for holding a plurality of medallions on each of the walls of the support member stacked one on top of another and accessible from an exterior of the support member;

each medallion retainer comprising spaced apart edge members, and at least one of the edge members being resilient, the spaced apart edge members of each medallion retainer receiving end portions of medallions to be stacked, the edge members of each medallion retainer being spaced apart so that a medallion is insertable laterally of the stack and is retained by the respective resilient edge member.

2. The motivational device of claim 1 and a light mounted on a side of said medallion retainers opposite from an exterior of the support member, such that light passes through medallions having light transmitting properties when such medallions are supported on the medallion retainers.

3. The motivational device of claim 1, wherein the obelisk has a light source on interior thereof, an indicia opening through each wall adjacent the top of each wall, and separate plugs for the indicia openings comprising a set of opaque plugs and a set of light transmitting plugs.

4. The motivational device of claim 1, wherein the device includes a base, and a swivel for mounting the obelisk relative to the base to permit rotating the obelisk to a plurality of selected positions.

5. The motivational device of claim 1, wherein the base defines an interior space for mounting components for control of the display of motivational messages and for storing such messages.

6. A motivational device comprising a generally upright sculptural work of art having at least one wall and an interior space;

the wall having an opening that is elongated in at least one direction, and the opening having opposite side edges extending in the one direction;

a medallion retainer supported at the opposite side edges of the opening; and a light source mounted on the interior of the upright sculptural work of art such that light passes through the opening, and at least one light transmitting medallion removably supportable in the medallion retainer.

7. The motivational device of claim 6 wherein said medallion retainer comprises at least one resilient member extending along aside edge of the opening.

8. The motivational device of claim 7 used in combination with a medallion having opposite ends that are supported on the medallion retainer with a main portion of the medallion spanning the opening.

9. The motivational device of claim 8 and a separate number of medallions having opaque characteristics supportable in the medallion retainer and replaceable by light transmitting medallions in the medallion retainer.

10. The motivational device of claim 9 and a plurality of light transmitting medallions formed of differing colors for indicating different achievements toward an ultimate goal.

11. The motivational device of claim 8, wherein the medallion is formed to have a generally elliptical plan view, and rounded opposite ends to aid slipping into the medallion retainer wherein the medallion spans the opening across a major portion of the opening.

12. The motivational device of claim 11, wherein each medallion has a top and a bottom including a portion raised into a convex configuration extending laterally and longitudinally, and the bottom surface of one medallion having a recess formed complimentary to receive the raised portion of the top of a second medallion immediately below the one medallion.

13. The motivational device of claim 6 wherein said sculptural work of art is an obelisk, having four generally upright walls forming an enclosure around the interior, and the light source is mounted within the enclosure formed by the four walls and extends substantially coextensively with the medallion retainer.

14. The motivational device of claim 13 and a base supporting the obelisk, the base defining an interior space for mounting components for control of displaying motivational messages and storing such messages.

15. The motivational device of claim 14 and a drawer member in the base for supporting a keyboard forming one of the components.

16. The motivational device of claim 15, wherein the components include a memory for storing and controlling a display to provide messages in accordance with a program provided.

17. The motivational device of claim 13 and a pyramidal cap on the upper portions of the obelisk, said pyramidal cap having four triangularly shaped walls joining at a peak and joining the respective walls of the obelisk at base ends of the triangular shaped walls, and at least one of the pyramidal cap triangularly shaped walls having an opening of size to receive a selected plug.

18. The motivational device of claim 6 wherein the wall of the motivational device has a plurality of openings for retaining medallions, a base member mounting the wall for rotation relative to the base member, means to sense the relative position of each opening relative to a reference position and provide a position signal, and a display circuit capable of storing information relating to activities toward achieving goals represented at each opening, including memory for storing information and displaying such information for each respective opening as determined by the respective position signal.

19. A motivational device combined with an achievement indicating medallion for indicating steps in achievement of a goal comprising;

a support member;

a medallion retainer on the support member for holding a plurality of medallions stacked one contiguous with another accessible from an exterior side of the support member for holding medallions on the support member, the medallion retainer comprising spaced apart resilient members for receiving end portions of medallions to be stacked; and a medallion that is elongated in an end to end direction, the medallion retainer engaging only portions of ends of the medallion when the medallion is inserted in the medallion retainer.

20. A motivational device for indicating steps in achievement of a goal comprising;

a support member having an outer periphery;

a plurality of medallion retainers around the outer periphery of the support member, each for holding a plurality of medallions stacked one on top of another and accessible from an exterior side of the support member said medallion retainers each comprising spaced apart edge members, and at least one of the edge members of each medallion retainer being resilient, the spaced apart edge members of each medallion retainer receiving end portions of medallions to be stacked, the edge members of each medallion retainer being spaced apart so that a medallion is insertable laterally of a stack and is retained by the associated resilient edge member;

a base for mounting the support member and medallion retainers for rotation relative to the base;

a position sensor to sense the relative rotational position of each of the medallion retainers relative to a reference position on the base and provide a position signal; and a display including a circuit capable of storing information relating to activities toward achieving goals represented at each of the medallion retainers, including memory for storing information and displaying such information for each respective medallion retainer as determined by the respective position signal.

* * * * *

UNITED STATES PATENT AND TRADEMARK OFFICE

CERTIFICATE OF CORRECTION

PATENT NO. : 5,506,010
DATED : April 9, 1996
INVENTOR(S) : Buck et al.

It is certified that error appears in the above-indentified patent and that said Letters Patent is hereby corrected as shown below:

Column 7, line 6, after "on" insert --an--.

Column 7, line 31, cancel "aside" and insert --a side--.

Column 8, line 45, at the end of the line insert --;--.

Signed and Sealed this

Seventeenth Day of December, 1996

*Attest:*

*Attesting Officer*

BRUCE LEHMAN

*Commissioner of Patents and Trademarks*